US005257078A

United States Patent [19]

Kuroda

[11] Patent Number: 5,257,078

[45] Date of Patent: Oct. 26, 1993

[54] IMAGE HEATING APPARATUS REGULATING SHIFT OF ENDLESS FIXING FILM

[75] Inventor: Akira Kuroda, Yokohama, Japan

[73] Assignee: Canon Kabushiki Kaisha, Tokyo, Japan

[21] Appl. No.: 913,712

[22] Filed: Jul. 16, 1992

[30] Foreign Application Priority Data

Jul. 19, 1991 [JP] Japan ..... 3-203250

[51] Int. Cl.[5] ..... G03G 15/20; H05B 1/00

[52] U.S. Cl. ..... 355/290; 355/285; 219/216

[58] Field of Search ..... 355/285, 289, 290; 219/216, 388; 198/840

[56] References Cited

U.S. PATENT DOCUMENTS 5,027,160 6/1991 Okada et al. ..... 355/282
5,119,143 6/1992 Shimura ..... 219/216
5,148,226 9/1992 Setoriyama et al. ..... 219/216
5,149,941 9/1992 Hirabayashi et al. ..... 219/216
5,153,655 10/1992 Suzuki et al. ..... 219/388
5,196,895 3/1993 Setoriyama et al. ..... 355/285

*Primary Examiner*—Bruce A. Reynolds
*Assistant Examiner*—Gregory Mills
*Attorney, Agent, or Firm*—Fitzpatrick, Cella, Harper & Scinto

[57] ABSTRACT

An image heating apparatus comprises a heating body, an endless film moving together with a recording sheet, a pressurizing member cooperating with the heating body to form a nip therebetween with the interposition of the endless film and a regulating member for regulating an edge of the endless film, and wherein an image on the recording sheet is heated by heat from the heating body via the endless film and the regulating member has a regulating surface at a downstream side of the nip in such a manner that a distance of the regulating surface and the endless film is gradually decreased toward the downstream side in a film moving direction. Whereby, the shift of the endless film is effectively regulated without damaging the endless film.

6 Claims, 6 Drawing Sheets

IMAGE HEATING APPARATUS REGULATING SHIFT OF ENDLESS FIXING FILM

BACKGROUND OF THE INVENTION

1. Field of the Invention

The present invention relates to an image heating apparatus for heating an image formed on a recording sheet with an endless film, and, more particularly, it relates to an apparatus for fixing an image that results in improved surface features of a fixed image.

2. Related Background Art

In the past, fixing apparatuses of the heat roller type have been used to thermally fix an image onto a recording sheet. An image heating apparatus wherein an image on a recording sheet was heated via a thin film has also been proposed, as described in U.S. Ser. No. 206,767 and the like. Since an this image heating apparatus of the film can utilize a heating body having a low heat capacity and can concentrate the heat at a nip area, it is possible to reduce power consumption and to reduce or eliminate the wait time.

If an endless film is used with this image heating apparatus of film type, the deviation or shift of the endless film will occur. However, it is difficult to strictly control such shift of the endless film.

In U.S. Ser. Nos. 712,532, 712,573 and 798,546, a technique is used whereby a film is loosely wound to reduce the shift force of the endless film and the shift of the film is regulated by engaging edges of the endless film by flanges. In such a technique, the film is driven by a pressure rotary member which cooperates with a heating body to form a nip with the film interposed, and the flanges are disposed along the length of the film except for an area corresponding to the nip.

However, when the edges of the film are regulated by the flanges in this way, if the shift force of the film becomes great, the bending, wrinkles and/or crack will occur in the film, with the result that, in the image heat fixing apparatus, the deterioration of the fixed image, the poor running of the fixing film, the reduction of the service life of the film and/or noise due to the film shift regulation will occur.

SUMMARY OF THE INVENTION

An object of the present invention is to provide an image heating apparatus which can regulate the shift of an endless film by supporting edges of the film without damaging the film.

Another object of the present invention is to provide an image heating apparatus which can gradually regulate edges of an endless film after it passes through a nip.

A further object of the present invention is to provide an image heating apparatus which regulates the shift of an endless film after the film passes through a nip, thus being done by regulating member having a regulating surface extending toward a downstream side of the endless film in such a manner that a distance between the regulating surface and the endless film is gradually decreased.

The other objects of the present invention will be apparent from the following descriptions.

DETAILED DESCRIPTION OF THE PREFERRED EMBODIMENTS

The present invention will now be explained with reference to the accompanying drawings.

Figure 1:
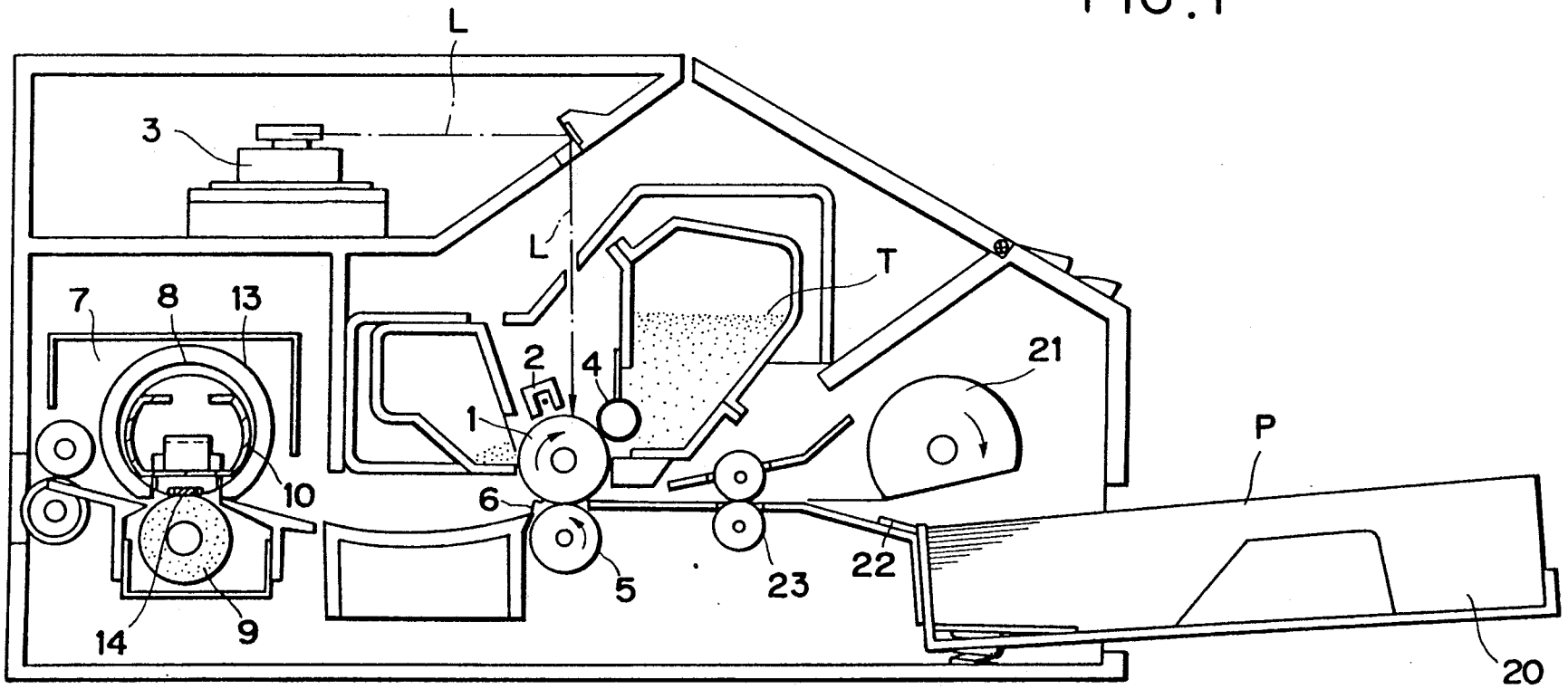
FIG. 1 is an elevational sectional view of an image forming system incorporating an image heating apparatus according to a preferred embodiment of the present invention as a fixing device.

FIG. 1 is an elevational sectional view of a laser beam printer as an image forming system incorporating an image heating apparatus as a fixing device according to a preferred embodiment of the present invention.

In FIG. 1, the laser beam printer includes an electrophotographic photosensitive member (referred to as "drum" hereinafter) 1 rotated at a predetermined peripheral speed. During rotation, the drum 1 is uniformly charged with a predetermined positive or negative potential by a primary charger 2, and image information is written on the drum with laser scan exposure light beam L by a laser scanner 3, thus forming an electrostatic latent image on the drum 1. The electrostatic latent image formed on the drum 1 is developed with toner T by a developing device 4 to visualize the image as a toner image.

Transfer sheets (recording sheets) P stacked in a sheet supply cassette 20 are separated and supplied one by one by a sheet supply roller 21, and a separation pad 22 to reach a pair of registering rollers 23. When the toner image reaches a transfer roller 5, it is gradually transferred onto the transfer sheet P fed to a transfer station between the transfer roller 5 and the drum 1 in a timed relation to the toner image by the regist rollers 23. The transfer of the image from the drum 1 to the transfer sheet P is effected by charging the back surface of the transfer sheet P with potential polarity opposite to that of the toner image by means of the transfer roller 5. Then, the charge on the transfer sheet P is removed by a charge removing needle 6 to which a voltage having the polarity opposite to that of the transfer roller 5 is applied. In this way, the transfer sheet is separated from the transfer roller and is fed to a heating apparatus 7. In the heating apparatus 7, the toner T on the transfer sheet P is thermally fused, thereby fixing the toner image to the transfer sheet P as a permanently fixed image.

Figure 2:
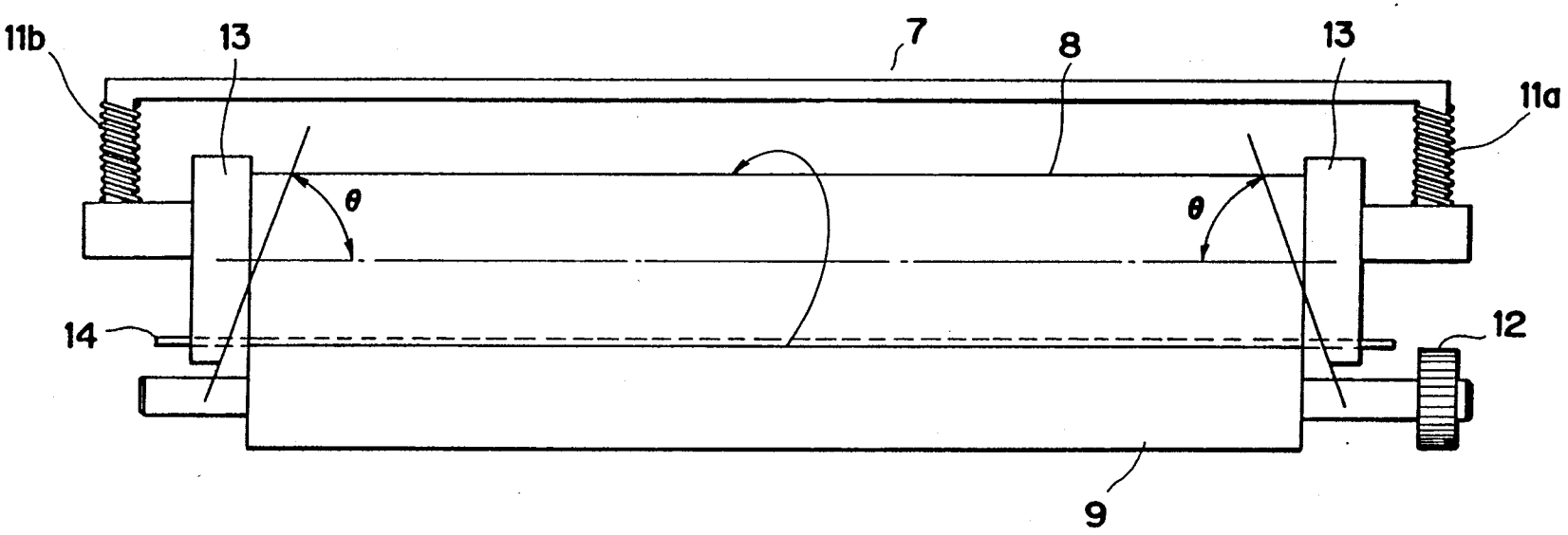
FIG. 2 is an elevational view of the image heating apparatus of FIG. 1.
Figure 3:
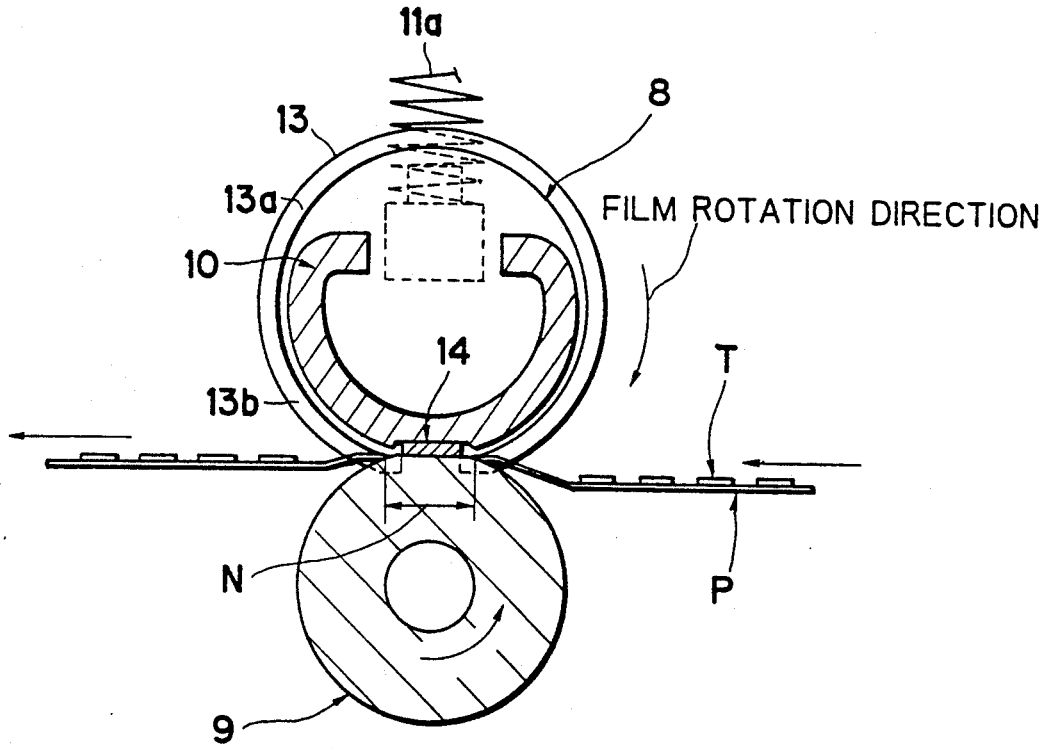
FIG. 3 is a cross-sectional view of the image heating apparatus.

FIG. 2 is an elevational view of the image heating apparatus 7, and FIG. 3 is a cross-sectional view of the image heating apparatus 7.

The heating apparatus comprises an endless fixing film 8 having good heat resistance, toner separating ability and strength, which film is comprised of a single layer film or a multi-layer film which is subjected to the desired surface treatment or laminating treatment. For example, the fixing film may comprise a single layer film made of polyester (PET) or polyimide (PI) having a thickness of about 50 μm and subjected to the heat-resisting treatment, or a multi-layer film consisting of such film and a mold-releasing layer of polytetrafluoroethylene (PTFE).

The fixing film 8 is loosely wound around a film guide 10 in such a manner that, at least in a stopped condition, no tension is applied to the film except at a nip or a portion where the film is nipped.

A pressure roller 9 is driven by a drive source (not shown), and the fixing film 8 is moved only from the friction force between the film and the pressure roller 9. A heater 14 abutted against the film guide 10 for guiding an inner surface of the fixing film 8 across the whole longitudinal area of the film is urged against the pressure roller 9 with a predetermined urging force (for example, 3–6 kg in total regarding the sheet having A4 width). A wire-shaped or strip-shaped thin film heating resistive portion made of $TaSiO_2$, silver palladium, $Ta_2N$, $RuO_2$, nichrome or the like is formed on a surface of the heater 14 by depositing, spattering, CVD, or screen printing techniques.

Regulating surfaces 13*a* of flanges 13 for regulating the shift of the fixing film are positioned perpendicular to a centerline of the fixing film except for surface areas 13*b* at a downstream side of the nip.

The heater 14 has a width longer than that of the fixing film because the heater is pressurized and an electrode portion for energizing the heater is required to provide on the heater. Accordingly, the regulating surfaces of the flanges are cut out at the nip area to avoid the interference between the heater and the flanges.

In order to regulate the edges of the fixing film again at a downstream side of the fixing nip after the film passes through the nip, each regulating surface is inclined by an angle $\theta$ with respect to the centerline of the fixing film when the film is in a stationary condition, such angle being selected to have a relation $\theta<90°$. With this arrangement, the regulating surfaces of the flanges approach the edges of the film gradually toward the downstream side regarding a film moving direction, thereby decreasing a distance between each regulating surface and the corresponding edge of the film.

Figure 4:
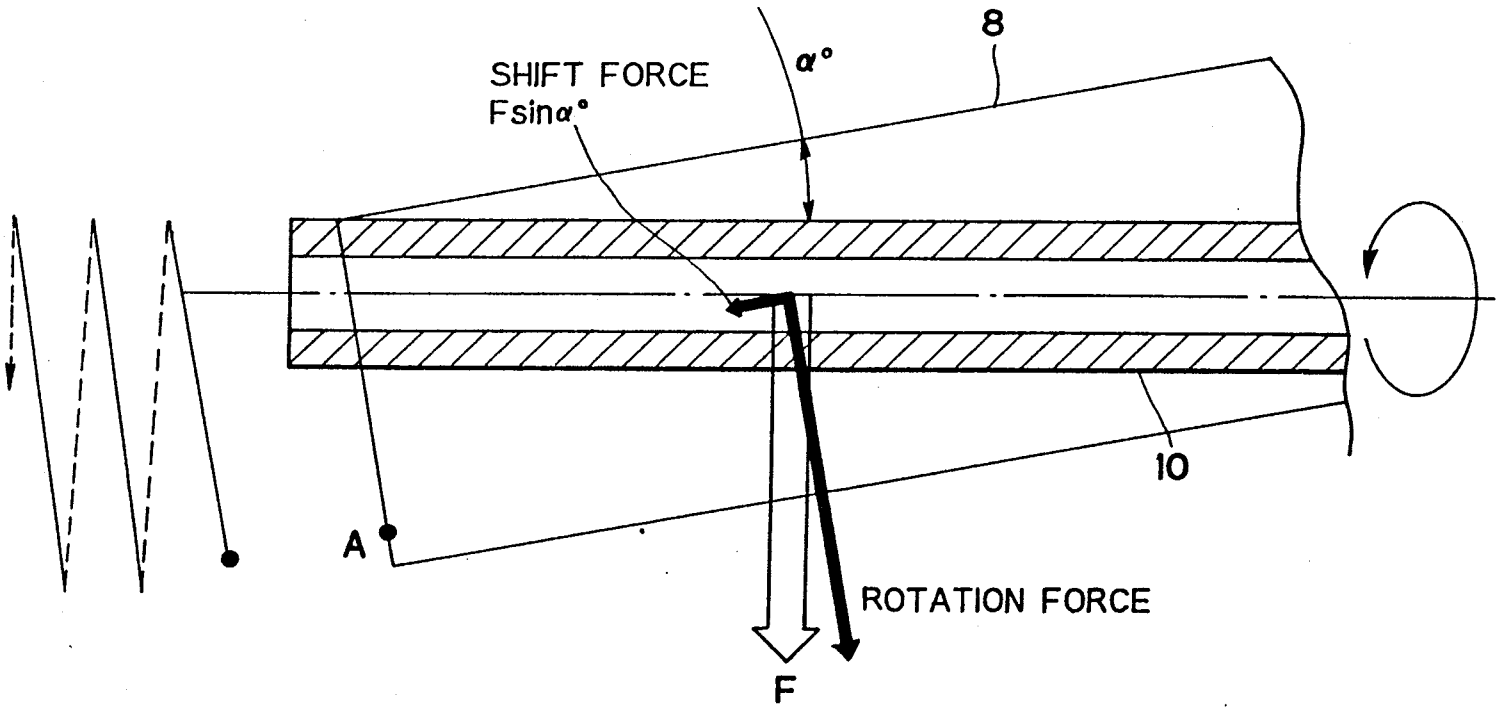
FIG. 4 is a plan view for explaining the shift of an endless film.

FIG. 4 is a plan view showing a condition where the shift of the fixing film occurs. The shift of the fixing film will occur if the positional accuracy of various elements (particularly, heater, pressure roller) is insufficient and/or if a feeding force of the fixing film is not uniform in the widthwise direction of the film due to the change in temperature in the widthwise direction of the heater and/or if the manufacturing accuracy of the fixing film itself (thickness, cylindricality or the like) is insufficient. However, in any cases, the shift of the fixing film occurs uniformly as shown in FIG. 4. That is to say, the difference in the film feeding force due to the above factors causes the centerline of the fixing film to incline with respect to the film guide and the flanges by an angle $\alpha°$, in accordance with the degree of the difference in peripheral length between the fixing film and the film guide. On the basis of a force (frictional force) perpendicular to the widthwise direction of the pressure roller, the fixing film is shifted by a force $F\sin_{60}°$. In this case, if there are no flanges, a point A situated on the edge of the fixing film will generate a spiral locus as shown in FIG. 4. However, in practice, due to the presence of the regulating flanges, the fixing film is moved as if it is rotated in parallel with the film guide (while being regulated by the flanges).

Figure 5:
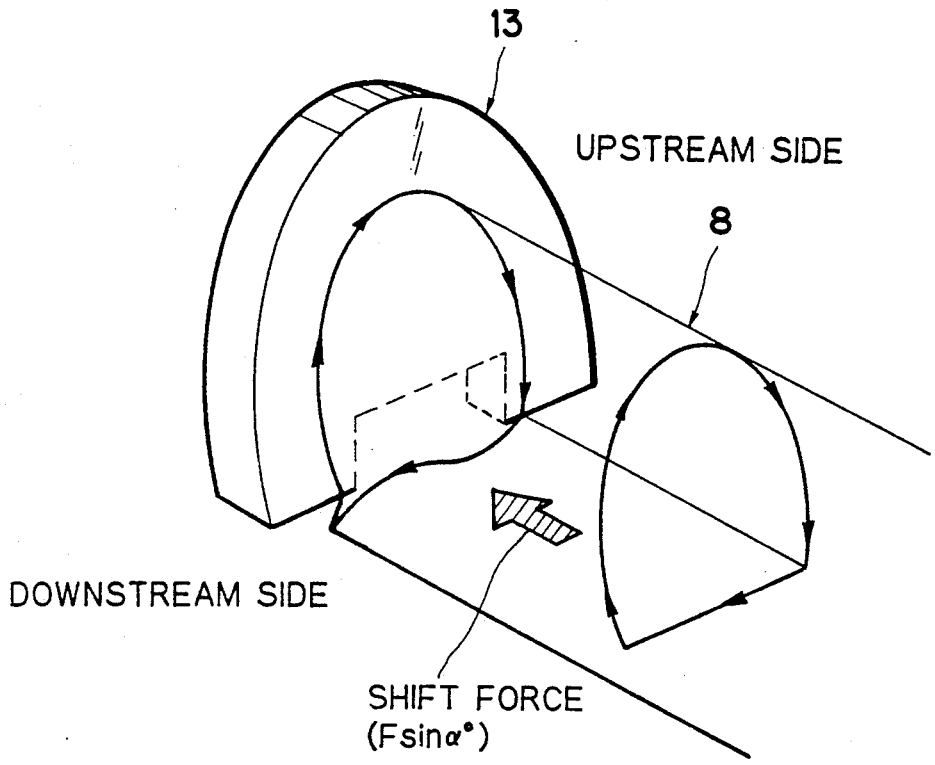
FIG. 5 is a partial perspective view for explaining a problem regarding the regulation of the shift of the endless film.

By the way, at the nip area where the rotation force and the shift force are applied to the fixing film, the edges of the fixing film are not subject to the shift regulation for the reason mentioned above. Thus, as shown in FIG. 5, the edge of the rotating thin fixing film is greatly displaced laterally from the upstream side of the nip area where the shift regulation is once released to the downstream side of the nip area where the shift regulation is again started. In this case, when the displaced edge of the fixing film is abruptly regulated again at the downstream side of the nip area as in the conventional case, the edge of the fixing film is damaged.

To the contrary, according to the illustrated embodiment of the present invention, since the regulating surfaces of the flanges at the downstream side of the nip area are so arranged that the distance between each regulating surface and the corresponding edge of the fixing film is gradually decreased toward the downstream side in the film moving direction, the following advantages can be obtained.

This is to say, although the regulating noise, and the wrinkles and/or the crack in the fixing film occur when the locus of the fixing film is abruptly regulated at the downstream side of the nip area as in the conventional case, in the illustrated embodiment, since the force opposing to the shift force gradually acts on the edge of the fixing film at the downstream side of the nip area by the corresponding regulating surface, the above-mentioned conventional drawback is minimized or eliminated, thus avoiding the poor fixing due to the occurrence of the wrinkles and extending the service life of the fixing film.

Further, since the position where the edges of the fixing film are positively regulated can be spaced apart from the nip area sufficiently, it is possible to further reduce the damage of the film. In addition, although the occurrence of the flash and notches had to be strictly controlled in the conventional cutting operation of the edges of the fixing film, with the arrangement according to the illustrated embodiment of the present invention, since the edge of the fixing film is not regulated abruptly, even if there are the flash and notches in the edge of the film, the load is not from being concentrated into the flash and the notches. Therefore, these severe manufacturing conditions with respect to the fixing film can be avoided, thus making the manufacturing cost inexpensive.

Figure 6:
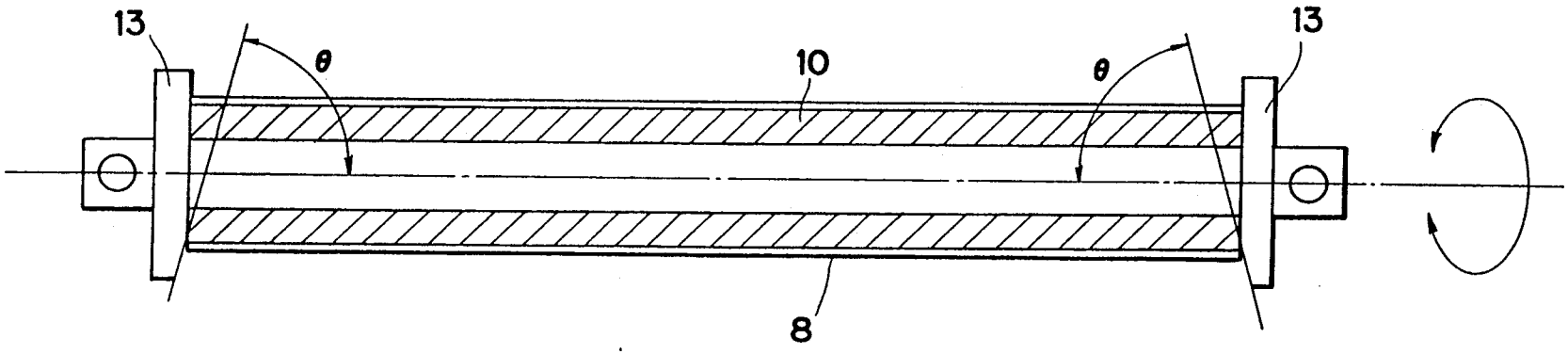
FIG. 6 is a plan view showing another embodiment of the present invention.

FIG. 6 shows another embodiment of the present invention.

Although the regulating surfaces of the flanges are inclined by the angle $\theta$ in the elevational view of the fixing unit (as shown in FIG. 2) in the aforementioned first embodiment, in this second embodiment (FIG. 6), the regulating surfaces of the regulating flanges at the downstream side of the fixing nip area are inclined by an angle $\theta$ with respect to the centerline of the fixing film when the film is in the stationary condition, in the plan view of the fixing unit as shown in FIG. 6, so that the relation $\theta<90°$ is obtained.

Also in this second embodiment, it is possible to gradually regulate the edges of the skew-moving thin fixing film along the spiral locus, at the downstream side of the fixing nip area. Incidentally, it is also preferable to gradually release the regulation for the edges of the fixing film at an upstream side of the nip area in the film moving direction, by providing regulating surfaces on the regulating flanges in such a manner that a distance between each regulating surface and the film is gradually increased toward the nip area.

While the present invention was explained with reference to the specific embodiments, it is not limited to such embodiments, but various alterations and modifications can be adopted without departing from the scope of the present invention.

What is claimed is:

1. An image heating apparatus comprising:

a heating body;

an endless film moving together with a recording sheet;

a pressurizing member cooperating with said heating body to form a nip therebetween with the interposition of said endless film; and a regulating member for regulating at least one edge of said endless film; and wherein an image on said recording sheet is heated by heat from said heating body via said endless film and said regulating member has a regulating surface at a downstream side of said nip in such a manner that a distance of said regulating surface and said endless film is gradually decreased toward the downstream side in a film moving direction.

2. An image heating apparatus according to claim 1, wherein said regulating member regulates said endless film except for at said nip.

3. An image heating apparatus according to claim 2, wherein said heating body has a length longer than a width of said endless film.

4. An image heating apparatus according to claim 3, wherein said pressurizing member comprises a rotary member rotated by a driving force, and said endless film is driven by the rotation of said rotary member.

5. An image heating apparatus according to claim 1, wherein said regulating member are arranged at both sides of said endless film.

6. An image heating apparatus according to claim 1, wherein said regulating member has a regulating surface at an upstream side of said nip in the film moving direction in such a manner that a distance of said regulating surface and said endless film is gradually increased toward said nip.

* * * * *

UNITED STATES PATENT AND TRADEMARK OFFICE

CERTIFICATE OF CORRECTION

PATENT NO. : 5,257,078

DATED : October 26, 1993

INVENTOR(S) : AKIRA KURODA

It is certified that error appears in the above-indentified patent and that said Letters Patent is hereby corrected as shown below:

COLUMN 3

Line 60, "$F\sin 60°$" should be --$F\sin\alpha°$--.

Signed and Sealed this

Tenth Day of May, 1994

Bruce Lehman

*Attest:*

BRUCE LEHMAN

*Attesting Officer*

*Commissioner of Patents and Trademarks*